United States Patent [19]

Bensing et al.

[11] Patent Number: 4,874,325

[45] Date of Patent: Oct. 17, 1989

[54] ELECTRICAL CONNECTOR WITH INTERFACE SEAL

[75] Inventors: Gregory L. Bensing; Joseph H. Gladd, both of Courtland; John A. Yurtin, Southington, all of Ohio

[73] Assignee: General Motors Corporation, Detroit, Mich.

[21] Appl. No.: 248,059

[22] Filed: Sep. 23, 1988

[51] Int. Cl.[4] ..... H01R 13/52

[52] U.S. Cl. ..... 439/272; 439/281

[58] Field of Search ..... 439/271, 283

[56] References Cited

U.S. PATENT DOCUMENTS

| | | | |
|---|---|---|---|
| 2,619,515 | 11/1952 | Doane | 439/279 |
| 3,937,545 | 2/1976 | Cairns | 439/272 |
| 4,029,382 | 6/1977 | Koda | 339/94 |
| 4,556,226 | 12/1985 | Ito | 439/273 |
| 4,601,528 | 7/1986 | Spier | 439/277 |
| 4,621,883 | 11/1986 | Noguchi | 439/271 |
| 4,637,674 | 1/1987 | Kobler | 439/271 |
| 4,693,535 | 9/1987 | Frade | 439/277 |
| 4,711,509 | 12/1987 | Cross et al. | 439/271 |

*Primary Examiner*—David Pirlot

*Attorney, Agent, or Firm*—F. J. Fodale

[57] ABSTRACT

An electrical connector has an interface seal mounted on a plug portion of a thermoplastic connector body which serves as the mounting surface for the interface seal. The plug portion has a conformation which opens onto the mounting surface and the interface seal has a retainer portion which snaps into the conformation to assure that the interface seal is always correctly positioned. The interface seal has a sealing portion which is made of silicone compounds and the retainer portion is made from thermoplastic material or silicone compounds having a substantially higher durometer than the silicone compounds of the sealing portion.

10 Claims, 1 Drawing Sheet

ELECTRICAL CONNECTOR WITH INTERFACE SEAL

BACKGROUND OF THE INVENTION

This invention relates generally to electrical connectors and more specifically to electrical connectors having interface seals for sealing the joint between coupled connectors.

U.S. Pat. No. 4,029,382 granted to Yosiharu Koda June 14, 1977 discloses watertight means for electric plug-receptacle couplings comprising a tubular packing which is secured by adhesive to the outer periphery of a support of a plug receiver. The tubular packing provides an interface seal between the coupled plug and plug receiver. It has a plurality of annular flanges and it is made from an elastomeric material such as isobutylene-isoprene rubber.

SUMMARY OF THE INVENTION

The object of this invention is to provide a improved arrangement for mounting an interface seal or tubular packing on an electrical connector.

A feature of the invention is that the interface seal mounting arrangement provides a means of assuring that the interface seal is always correctly positioned without the need for adhesives, plastic locks, metal clips or the like.

Another feature of the invention is that the interafce seal has a flexible sealing portion and a stiffly flexible retainer portion which cooperates with a simple conformation of the electrical connector to assure that the seal is correctly positioned for sealing engagement with a mating electrical connector.

In one aspect another feature of the invention is that the interface seal mounting arrangement comprises a dual durometer interface seal which has a flexible elastomeric sealing portion and a stiffly flexible elastomeric retaining portion of higher durometer which cooperates with a simple conformation of the electrical connector to assure the interface seal is always correctly positioned.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENTS

Figure 1:
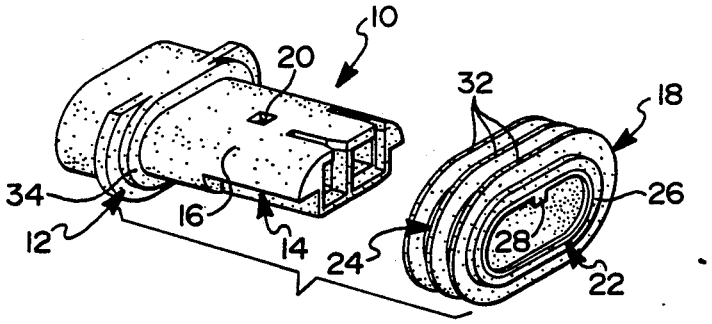
FIG. 1 is an exploded perspective view of an electrical connector having an interface sealing arrangement in accordance with the invention.
Figure 2:
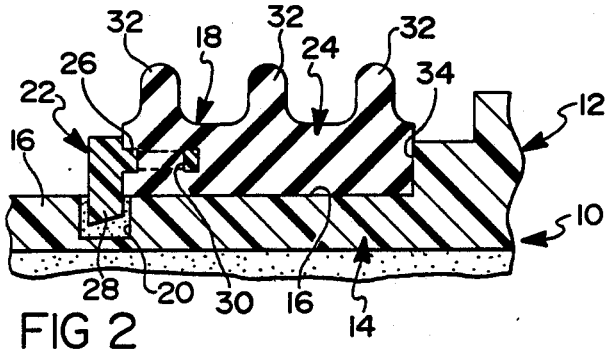
FIG. 2 is a longitudinal section of the electrical connector which is shown in FIG. 1.

Referring now to the drawing and more particularly to FIGS. 1 and 2, an electrical connector having an interface sealing arrangement in accordance with the invention is indicated generally at 10. The electrical connector 10 comprises a thermoplastic connector body 12 which houses a plurality of electrical terminals (not shown) in conventional manner. The connector body 12 has a plug portion 14 of reduced size which serves as the mounting surface 16 for an interface seal 18.

The plug portion 14 has a cavity 20 which opens onto the mounting surface 16. The interface seal comprises a stiffly flexible retainer portion 22 and a flexible elastomeric sealing portion 24. The retainer portion 22 comprises an annular member 26 and a radial lock member 28 which depends radially inwardly from the annular member 26. The annular member 26 includes windows 30. The stiffly flexible retainer portion 22 may be made from a thermoplastic material such as polypropylene or a higher durometer elastomeric material such as silicone compounds having a durometer of about 80–90.

The flexible elastomeric sealing portion 24 is moloded over the retainer portion 22 so that the tip of the radial lock member 28 is exposed as shown in FIGS. 1 and 2. The sealing portion 24 fills the windows 30 to form a secure interlock between the retainer portion 22 and the sealing portion 24. The sealing portion 24 includes a plurality of flexible radial sealing lips 32 which engage a sealing surface on the mating connector body (not shown). The sealing portion 24 is made of suitable flexible elastomeric sealing material such as silicone compounds having a durometer in the range of about 40–50.

When the interface seal 18 is mounted on the plug portion 14 of the connector body 12 against the shoulder 34, the tip of the radial lock member 28 snaps into the cavity 20 which opens onto the the mounting surface 16. Thus assures that the interface 18 is always correctly positioned for sealing engagement with the mating connector body.

Figure 3:
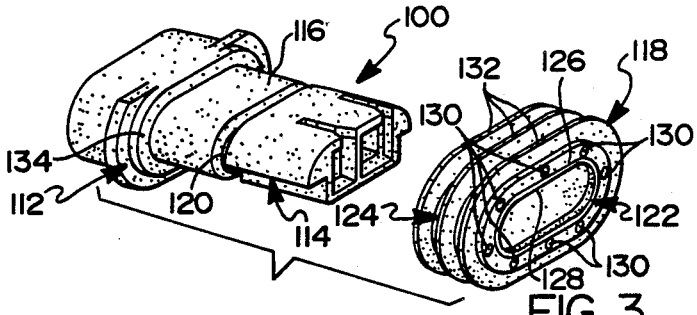
FIG. 3 is an exploded perspective view of an electrical connector having an alternate interface sealing arrangement in accordance with the invention.
Figure 4:
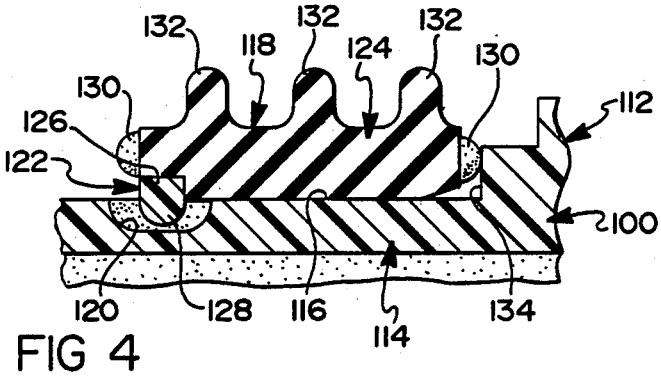
FIG. 4 is a longitudinal section of the electrical connector which is shown in FIG. 3.

An electrical connector having an alternate interface sealing arrangement in accordance with the invention is indicated generally at 100 in FIGS. 3 and 4. The electrical connector 100 also comprises a thermoplastic connector body 112 which houses a plurality of electrical terminals (not shown) in conventional manner. The connector body 112 also has a plug portion 114 of reduced size which serves as the mounting surface 116 for an interface seal 118.

The plug portion 114, however, has an annular groove 120 which opens onto the mounting surface 116. On the other hand, the interface seal 118 comprises a stiffly flexible retainer portion 122 in the form of an O-ring and a flexible elastomeric sealing portion 124. The O-ring retainer portion 122, which has a outer ring 126 of rectangular cross section is made from a higher durometer elastomeric material such as silicone compounds having a durometer of about 80–90.

The sealing portion 124 is molded over the retainer portion 122 so that the inner partcircular ring 128 is exposed as shown in FIGS. 3 and 4. The sealing portion 124 has a plurality of circumferentially spaced hemispherical bumps 130 at each end. These bumps 130 improve the anti-stick characteristics of the sealing portion 124 so that it does not adhere to the coupled connector bodies. The sealing portion 124 also includes a plurality of flexible radial sealing lips 132 which engage a sealing surface on the mating connector body (not shown). As before the sealing portion 124 is made of suitable elastomeric sealing material such as silicone compounds having a durometer in the range of about 40–50.

When the interface seal 118 is mounted on the plug portion 114 of the connector body 112 against the shoulder 134, the inner ring 128 of the O-ring retaining member 122 snaps into the annular groove 120 which opens onto the the mounting surface 116 thus assuring that the interface seal 118 is always correctly positioned.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector having an interface sealing arrangement comprising:

a thermoplastic connector body which houses a plurality of electrical terminals and which has a plug portion of reduced size which serves as mounting surface for an interface seal, said plug portion having a conformation which opens onto the mounting surface, said interface seal having a sealing portion which is made of an elastomeric material and a retainer portion which is made of thermoplastic material or elastomeric material having a higher durometer than the elastomeric material of the sealing portion, said retainer portion including a portion which snaps into the conformation which opens onto the mounting surface to assure that the interface seal is always correctly positioned for sealing engagement with a mating connector body.

2. The electrical connector as defined in claim 1 wherein the sealing portion is made of silicone compounds and the retainer portion is made from silicone compounds having a substantially higher durometer than the silicone compounds of the sealing portion so that the sealing portion is flexible enough to provide efficient sealing while the retainer portion is stiff enough to provide efficient retention.

3. An electrical connector having an interface sealing arrangement comprising:

a thermoplastic connector body which houses a plurality of electrical terminals and which has a plug portion of reduced size which serves as mounting surface for an interface seal, said plug portion having a cavity which opens onto the mounting surface, said interface seal having a flexible sealing portion which is made of an elastomeric material and a stiffly flexible retainer portion which is made of thermoplastic material or elastomeric material having a higher durometer than the elastomeric material of the flexible sealing portion, said retainer portion comprising an annular member and a radial lock member which depends radially inwardly from the annular member and which has an exposed tip which snaps into the cavity which opens onto the mounting surface to assuring that the interface seal is always correctly positioned in sealing engagement on the plug portion for sealing engagement with a mating connector body.

4. The electrical connector as defined in claim 3 wherein the sealing portion is made of silicone compounds and the retainer portion is made from silicone compounds having a substantially higher durometer than that of the silicone compounds of the sealing portion so that the sealing portion is flexible enough to provide efficient sealing while the retainer portion is stiff enough to provide efficient retention.

5. The electrical connector as defined in claim 3 wherein the sealing portion is made of silicone compounds having a durometer in the area of about 40–50 and the retainer portion is made from a thermoplastic material or silicone compounds having a durometer of about 80–90.

6. The electrical connector as defined in claim 3 wherein the annular member includes windows which are filled by the sealing portion to form a secure interlock between the retainer portion and the sealing portion and wherein the sealing portion includes a plurality of flexible radial sealing lips.

7. An electrical connector having an interface sealing arrangement comprising:

a thermoplastic connector body which houses a plurality of electrical terminals and which has a plug portion of reduced size which serves as mounting surface for an interface seal, said plug portion having an annular groove which opens onto the mounting surface, said interface seal having a flexible sealing portion which is made of an elastomeric material and a stiffly flexible retainer portion which is made of an elastomeric material having a higher durometer than the elastomeric material of the sealing portion, said retainer portion comprising an O-ring having an outer ring of rectangular cross section and an inner ring of partcircular cross section which is exposed and which snaps into the annular groove which opens onto the mounting surface to assure that the interface seal is always correctly positioned in sealing engagement on the plug portion for sealing engagement with a mating connector body.

8. The electrical connector as defined in claim 7 wherein the sealing portion is made of silicone compounds and the retainer portion is made from silicone compounds having a substantially higher durometer than that of the silicone compounds of the sealing portion so that the sealing portion is flexible enough to provide efficient sealing while the retainer portion is stiff enough to provide efficient retention.

9. The electrical connector as defined in claim 7 wherein the sealing portion is made of silicone compounds having a durometer in the area of aobut 40–50 and the retainer portion is made from silicone compounds having a durometer of about 80–90.

10. The electrical connector as defined in claim 7 wherein the sealing portion has a plurality of circumferentially spaced anti-stick bumps at each end and wherein the sealing portion includes a plurality of flexible radial sealing lips.

* * * * *